United States Patent [19]

Graves et al.

[11] 4,165,738

[45] Aug. 28, 1979

[54] LIFE SUPPORT SYSTEM FOR DRILLING RIGS

[76] Inventors: Phillip H. Graves; Don L. Dyer, both of Box 6564, Odessa, Tex. 79762

[21] Appl. No.: 854,048

[22] Filed: Nov. 22, 1977

[51] Int. Cl.[2] ..... A62B 7/00

[52] U.S. Cl. ..... 128/142.4; 128/145 R; 128/203; 175/219; 166/113; 137/344; 280/5 E; 222/3

[58] Field of Search ..... 128/203, 140 R, 141 R, 128/142 R, 142.2, 142.3, 142.4, 142.6, 142.7, 145 R, 147, 185, 205; 175/219, 85; 166/113 R; 220/85 S; 137/344, 606; 280/5 R, 5 E; 222/3, 6

[56] References Cited

U.S. PATENT DOCUMENTS

| | | | |
|---|---|---|---|
| 2,087,300 | 7/1937 | Ragonnet | 222/6 X |
| 2,122,656 | 7/1938 | Paget | 137/344 |
| 2,138,988 | 12/1938 | Thomas | 137/606 X |
| 2,299,793 | 10/1942 | Cannaday et al. | 128/140 R |
| 2,317,064 | 4/1943 | Josephian | 280/5 R |
| 2,775,980 | 1/1967 | Renaudie | 222/6 X |
| 2,989,294 | 6/1961 | Coker | 175/219 X |
| 3,365,008 | 1/1968 | Zimmerman et al. | 175/85 |
| 3,400,732 | 9/1968 | Larrabee | 137/344 |

*Primary Examiner*—Henry J. Recla
*Attorney, Agent, or Firm*—Dennison, Dennison, Meserole & Pollack

[57] ABSTRACT

A portable vehicle-carried emergency breathing system including a plurality of bottles containing pressurized breathing gas and associated interconnected piping. An easily disconnectable line leads from the trailer to a manifold secured beneath the platform of the rig and from there to a plurality of multiple outlet manifolds at different locations on the rig. Lines from these manifolds are attached to face masks easily accessible to workers on or near the rig.

7 Claims, 3 Drawing Figures

LIFE SUPPORT SYSTEM FOR DRILLING RIGS

BACKGROUND OF THE INVENTION

1. Field of the Invention

Our invention relates generally to oil and gas field safety equipment, and particularly to a portable supply of breathing gas which can be hooked up to user access means situated at various locations on a drilling rig to provide emergency breathing air to workmen in an atmosphere of noxious or poisonous gas.

2. Description of the Prior Art

Exploration, drilling, completion and working of oil and gas wells involve numerous dangers to the health and safety of the workmen, and one serious problem arises from the possibility of emission of toxic gases and especially hydrogen sulphide ($H_2S$) during these operations. Numerous deaths in the oil fields in recent years have caused investigations at both the state and federal levels and as a result thereof both OSHA and the Texas Railroad Commission have enacted legislation requiring gas monitoring during the drilling and working of such wells. A system for sampling gases from wells to meet this requirement is disclosed in our copending application, Ser. No. 588,900 filed Apr. 19, 1977 now abandoned.

More recent requirements make it mandatory to provide breathing gas such as compressed cleaned air, accessible to all personnel at the well site. To date, no readily accessible and satisfactory system for providing the breathing gas has been found, and on many rigs gas bottles are scattered about the platform, which is already cluttered with tools and equipment and presents yet a new safety hazzard. Attempts have been made to provide each worker with a belt-attached portable air bottle and mask, however, in order to carry a reasonable quantity of air, the bottle would be too cumbersome and heavy and would be uncomfortable for the worker to carry, especially for those who must climb the derrick to the monkey board or walkaround.

SUMMARY OF THE INVENTION

It is the principal object of the present invention to provide a readily transportable emergency breathing system for an oil or gas rig which may be hooked into the rig by a quick-connect coupling to provide breathing air to a plurality of station manifolds easily accessible to the workmen.

Another object of the invention is to provide an emergency breathing system for an oil or gas drilling system derrick where the components are secured to the rig so as to be readily accessible yet they do not interfere with normal rig operation.

Still another object of the invention is to provide an easily transportable emergency breathing system for drilling rigs wherein the air supply may be replenished during use and which system is safe and dependable in use and is of rugged construction.

All of these objects as well as others are achieved by providing an assemblage of elements which may be stored and carried to the field in a single towable or air-transportable trailer. The trailer normally houses in several sets, a plurality of bottles of compressed breathing air and the necessary interconnecting piping so that, for example, four air bottles each may be connected in series to a quick disconnect fitting and regulator. Life lines, piping, manifolds and masks are then connected to this coupling with the manifolds being installed at several locations on the derrick structure.

It will be understood that the gas may be brought to the site already compressed in tanks or bottles or alternatively when permitted by law, the trailer may include a self-contained compressor.

All of the masks, lines, manifolds and accessory equipment such as monitors, wind socks, stretchers, portable gas bottles, warning signs, etc. may be carried in compartments on the trailer.

With the installation in place, all personnel at the site are but seconds away from a breathing mask, even those working above the well head on the monkey board.

These objects and advantages which will become subsequently apparent reside in the constructional and operational details as more fully hereinafter described and claimed reference being had to the accompanying drawings forming a part hereof, wherein like reference characters refer to like parts.

DESCRIPTION OF THE PREFERRED EMBODIMENT

Figure 1:
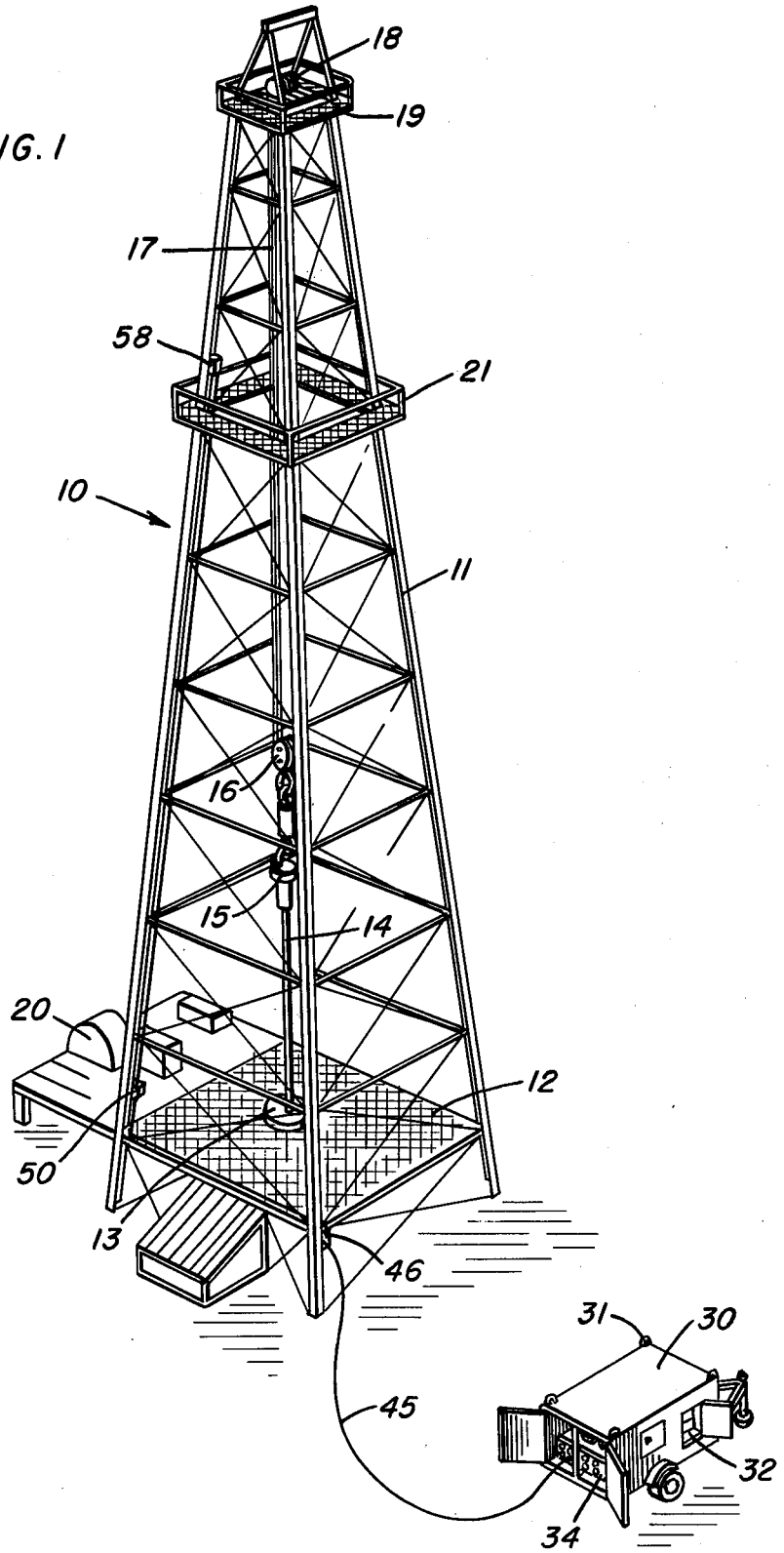
FIG. 1 is a perspective of a typical fixed drilling rig and showing our invention connected thereto.

A typical drilling rig with which the invention may be used is shown generally at 10 and consists of a derrick 11 having a base platform 12 on which is mounted a rotary table 13 which is adapted to rotate and drive the drill string 14 in a manner well known in the art. The drill string is supported in the rotary manner by a swivel 15 connected to a traveling block 16. Support and hoisting line 17 is reeved about the traveling block 16 up and over a crown block 18 mounted at the top of the derrick. A walkaround platform 19 surrounds the crown block and provides a work area for maintenance and repair of the upper portion of the superstructure. The cable then extends downwardly where it is secured to a draw works 20 which includes a winch and the necessary controls and brakes for pulling in and letting out of the cable and therefore allowing the drill string to descend into or be drawn from the hole.

With most large rigs found in the oil fields, a monkey board 21 is provided on the derrick. This board is generally located from 80 to 100 feet above the derrick platform 12 and serves as a work support for the derrickman who assists while a drill pipe is being run into the hole. The derrickman latches and unlatches elevators to enable the driller at the draw works to hoist and lower the pipe.

In order to provide the necessary safety breathing equipment at all locations on the rig, we have provided a life support trailer 30 which may be towed by a conventional tractor or even a small four-wheeled vehicle. Hook members 31 are provided at the top of the trailer so that the entire assembly may be handled by helicopter for use in otherwise inaccessible locations. The trailer includes a number of compartments as shown, for example, at 32 for the storage of supplemental equipment, tool kits, and additional safety devices such as stretchers, wind socks, portable self-contained breathing devices, and the like.

Mounted within the main body of trailer 30 is a plurality of compressed air bottles 33 of conventional configuration and construction. In the preferred form of the invention, we use eight air bottles grouped in two units of four, with each four bottles being mounted on a face plate 34 so that the tops thereof extend through apertures in these plates. Each bottle includes a conventional control valve 35 having a hand wheel 36 extending therefrom for manual opening, closing and regulation of the amount of flow from each bottle. The bottles are preferably filled with high quality, clean water-free compressed air of a type suitable for breathing and may be filled at a supply depot or alternatively by an air compressor in the trailer when permitted by law.

The bottles in each set of four are interconnected by means of air manifold lines 37 and 38. In effect, each bottle in the set is in series by virtue of the interconnection and T-taps. The final portion of the line coming from the last bottle in each set is connected to an inline check valve 39 and 40 and which prohibits backflow through the valve. The air line coming from these check valves terminates in a T 41 connected to a regulator 42 having a nipple connector 43 at its open end. All equipment is designed for at least 3000 psi test.

It will be understood that one or both banks of four air bottles 33 may be on line at the same time. If it is desired to change bottles to replenish exhausted bottles, one full set of four-bottles may be disconnected from the line with no danger of blow-back due to the action of the one-way check valves 39 and 40.

Figure 2:
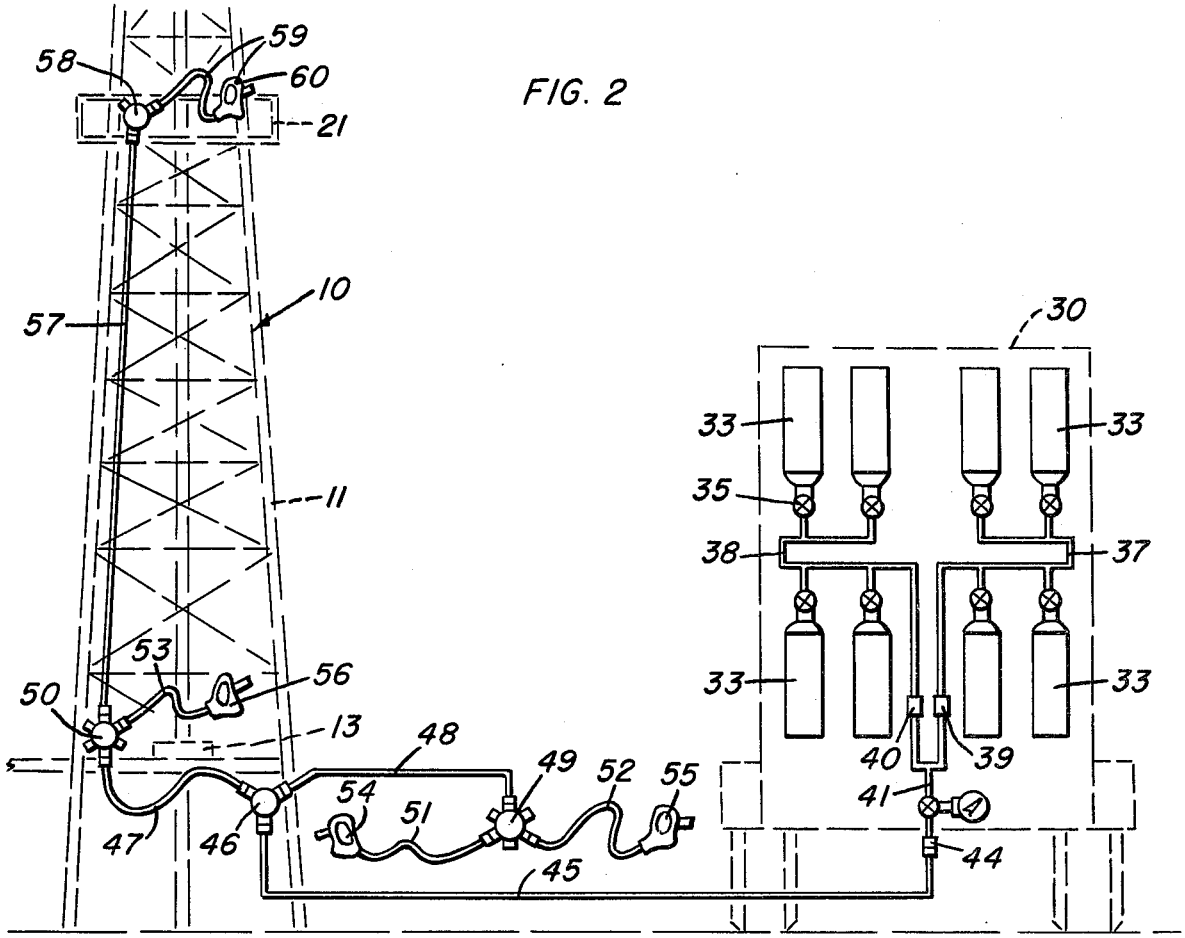
FIG. 2 is a schematic of the plumbing of the invention with the drilling rig and trailer shown in dotted lines.

The trailer-contained air supply is connected to breathing masks located at various positions on the derrick structure by means of a life line 45 having a quick disconnect coupling 44 adapted to connect to the nipple 43 in a well known manner. Line 45 connects into a two-way manifold 46 preferably located slightly below the floor level of the platform 12. As will be seen in FIG. 2, the manifold contains two outlet branches, each having a life line 47 and 48 connected thereto. Line 48 runs to a five-way manifold 49 which can be located on the ground near the derrick and has five outlet couplings, each adapted to receive an air line as shown at 51 and 52, for example. Each of these lines is connected to a breathing mask 54, 55. These masks are accessible to individual workmen near the base of the derrick. The line 47 extends to a five-way manifold 50 located adjacent to the draw works, preferably on one of the legs of the tower. One or more lines 53 may extend from the outlet of this manifold and each is connected to a face mask 56. One of the outlet legs from the manifold 50 connects to a long air line 57 which extends vertically up the derrick where it connects to a two-way manifold 58 located on the monkey board 21. An air line 59 connected to this manifold serves to provide safe breathing by virtue of mask 60 to one or more workmen on the monkey board. Additionally it will be obvious that if required a line may even extend up to walkaround 19.

In operation, the portable unit 30 will be towed or otherwise transported to the drilling rig and all of the accessory equipment can be easily and quickly unloaded and installed on the rig. Due to the quick disconnect coupling arrangement 43, 44, the air line 45 may be rapidly connected to the manifold 46 and associated lines then run to manifolds 50 and 58. In some instances, it may be desirable to have the various manifolds permanently installed on the drilling case which may be enclosed within a box or housing. The masks and the associated air lines can be secured to hooks or other storage elements adjusted to the manifolds, and yet readily accessible to drilling personnel upon the very first alarm or indication of presence of noxious gas.

Figure 3:
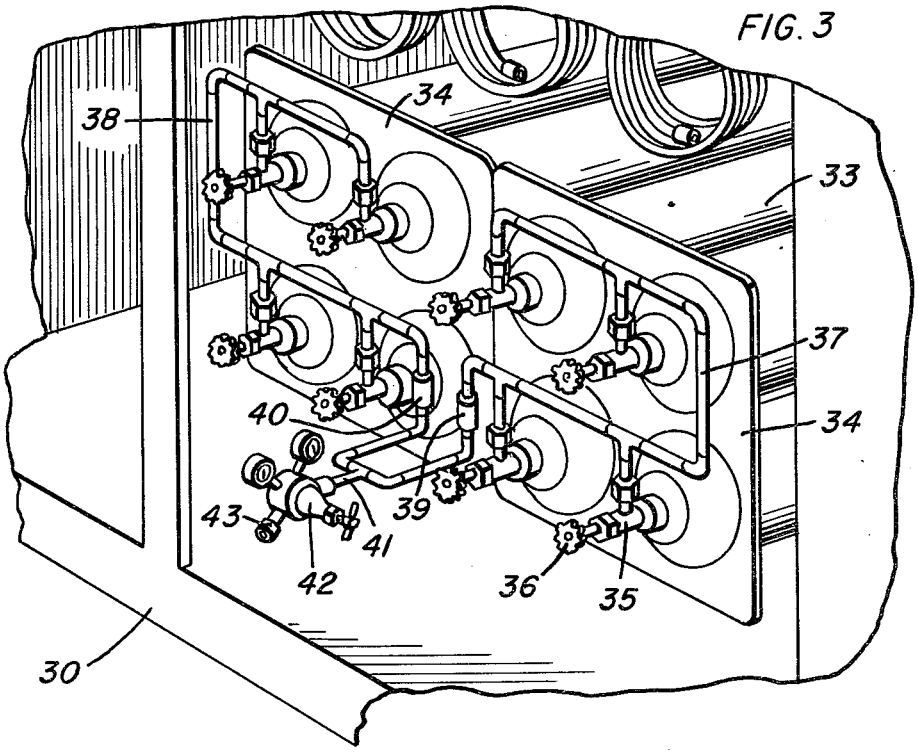
FIG. 3 is a perspective of the rear of the support trailer showing the air bottle hookup.

During use, it is contemplated that each of the hand wheels 36 associated with valves 35 will be opened to permit a full and continuous flow of breathing air to the regulator 32 which can be controlled with regard to volume. In the event one full bank of four bottles 33 becomes exhausted or is in need of replenishment, those four bottles can be shut down by turning off valves 35 by the hand wheels 36. There will be no danger of back flow from the other banks because of the one way check valves 39 and 40, and the air manifold lines 37, 38 can be disconnected from valve 35 by the nut member as shown in FIG. 3. The entire bank can then be removed along with face plate 34 and a new bank of four bottles can be placed on line.

In those locations where local legislation permits, the bottles can be substituted or augmented by an air compressor mounted within the trailer 30.

We claim:

1. In combination with a drilling rig having a platform, a draw works, a derrick extending upwardly therefrom, and at least one workman support on the derrick at an elevation substantially above said platform, the improvement comprising; an emergency breathing system for protection against toxic gases, said system including, a vehicle-carried supply of breathing gas consisting of a plurality of bottles of compressed air having outlets connected to a common outlet which can be located on the surfac adjacent said drilling rig, first manifold means mounted on said platform, conduit means interconnecting said first manifold and said common outlet of said supply, a plurality of breathing masks connected to said first manifold and located for use at various locations on said rig.

2. A breathing system as set forth in claim 1 and further including a second manifold means interconnected with said first manifold means and located on said workman support, and at least one breathing mask connected thereto.

3. A breathing system as defined in claim 2, wherein said first manifold means is located on said platform adjacent said draw works.

4. A breathing system as defined in claim 3 and further including a distribution manifold between and in communication with said first manifold means and said supply and being located below said platform.

5. A breathing system as defined in claim 1, wherein said bottles have their outlets interconnected in series and further including valve means for regulating the flow to said first manifold means.

6. A breathing system as defined in claim 5 and including check valve means to permit withdrawal of and replacement of at least one air bottle without interfering with the flow to the first manifold means.

7. A breathing system as defined in claim 6, and further including a face plate in said vehicle through which the bottles extend.

* * * * *